United States Patent [19]

O'Brien et al.

[11] Patent Number: 5,032,456

[45] Date of Patent: Jul. 16, 1991

[54] MICROCELLULAR SYNTHETIC PAINTBRUSH BRISTLES

[75] Inventors: Timothy D. O'Brien, Crofton; William M. Wagner, Severn, both of Md.

[73] Assignee: Newell Operating Company, Freeport, Ill.

[21] Appl. No.: 95,304

[22] Filed: Sep. 11, 1987

[51] Int. Cl.[5] ..... D02G 3/00

[52] U.S. Cl. ..... 428/398; 428/376; 428/365; 428/364; 15/159 A; 15/DIG. 5; 264/177.14

[58] Field of Search ..... 428/376, 398, 364, 365; 15/159 A; 264/177.14

[56] References Cited

U.S. PATENT DOCUMENTS

| | | | |
|---|---|---|---|
| 2,149,425 | 3/1939 | Draemann | 18/54 |
| 2,200,946 | 5/1940 | Bloch | 18/54 |
| 2,418,492 | 4/1947 | Alfthan et al. | 18/8 |
| 2,697,009 | 12/1954 | Ingraito | 300/2 |
| 2,907,096 | 10/1959 | Halbig | 28/82 |
| 3,118,161 | 1/1964 | Cramton | 15/159 A |
| 3,134,122 | 5/1964 | Charvat | 15/179 |
| 3,173,163 | 3/1965 | Cramton | 15/159 |
| 3,186,018 | 6/1965 | Shaw | 15/159 |
| 3,238,553 | 3/1966 | Bailey et al. | 15/159 |
| 3,256,545 | 6/1966 | Lewis, Jr. et al. | 15/159 |
| 3,295,156 | 1/1967 | Brant | 15/159 A |
| 3,313,000 | 4/1967 | Hays | 18/8 |
| 3,325,845 | 6/1967 | Sawkiw | 15/159 |
| 3,344,457 | 10/1967 | Grobert | 15/159 |
| 3,411,979 | 11/1968 | Lewis, Jr. | 15/159 A |
| 3,461,197 | 8/1969 | Lemelson | 264/172 |
| 3,463,652 | 8/1969 | Whitesel et al. | 117/7 |
| 3,493,549 | 2/1970 | Uemura | 260/85.3 |
| 3,522,342 | 7/1970 | Nungesser et al. | 264/210 |
| 3,551,280 | 12/1970 | Kippan | 161/175 |
| 3,567,569 | 3/1971 | Ono et al. | 161/179 |
| 3,577,839 | 5/1971 | Charvat et al. | 15/179 |
| 3,595,952 | 7/1971 | Boyer et al. | 264/235 |
| 3,605,162 | 9/1971 | Long | 264/177.14 X |
| 3,613,143 | 10/1971 | Muhler et al. | 15/167 R |
| 3,616,480 | 11/1971 | Feroce et al. | 15/159 A |
| 3,671,381 | 6/1972 | Hansen | 161/180 |
| 3,706,111 | 12/1972 | Curtin et al. | 15/159 A |
| 3,723,240 | 3/1973 | Skochdopole et al. | 161/173 |
| 3,745,061 | 7/1973 | Champaneria et al. | 161/178 |
| 3,785,919 | 1/1974 | Hicjman | 161/175 |
| 3,879,495 | 4/1975 | Fujii et al. | 260/878 R |
| 3,893,957 | 7/1975 | Mixon et al. | 260/2.5 |
| 3,931,386 | 1/1976 | Kimura et al. | 264/236 |
| 3,957,936 | 5/1976 | Lauchenauer | 428/398 X |
| 4,010,308 | 3/1977 | Wiczer | 428/379 X |
| 4,020,229 | 4/1977 | Cox, Jr. | 428/372 |
| 4,133,147 | 1/1979 | Swift, Jr. | 51/400 |
| 4,144,371 | 3/1979 | Okie et al. | 428/255 |
| 4,161,050 | 7/1979 | Sasaki et al. | 15/159 A |
| 4,254,182 | 3/1981 | Yamaguchi et al. | 428/372 |
| 4,279,053 | 7/1981 | Payne et al. | 15/159 A |
| 4,297,414 | 10/1981 | Matsumoto | 428/400 |
| 4,307,478 | 12/1981 | Ward et al. | 15/159 A |
| 4,318,998 | 3/1982 | Berglund | 521/54 |
| 4,357,379 | 11/1982 | Sloan et al. | 428/113 |
| 4,409,372 | 10/1983 | Ward et al. | 428/398 X |
| 4,485,141 | 11/1984 | Fujimura et al. | 428/288 |
| 4,507,361 | 3/1985 | Twilley et al. | 428/373 |
| 4,515,858 | 5/1985 | Bayan | 428/364 |
| 4,522,884 | 6/1985 | Brody | 428/400 |
| 4,552,810 | 11/1985 | Norota et al. | 428/398 |
| 4,559,268 | 12/1985 | Nakashima et al. | 428/397 |
| 4,562,022 | 12/1985 | Li et al. | 264/54 |
| 4,666,452 | 5/1987 | Nohr et al. | 8/115.52 |

*Primary Examiner*—P. C. Ives

*Attorney, Agent, or Firm*—James G. Staples

[57] ABSTRACT

Synthetic microcellular paintbrush bristles are produced having a generally consistent cross-sectional shape along their length and a rough and irregular surface. The bristles comprise 15 to 40% cells on a volume basis, the cells being predominantly closed in the interior of the bristle and being open along the wall to provide the rough and irregular surface.

12 Claims, 2 Drawing Sheets

FIG. 1
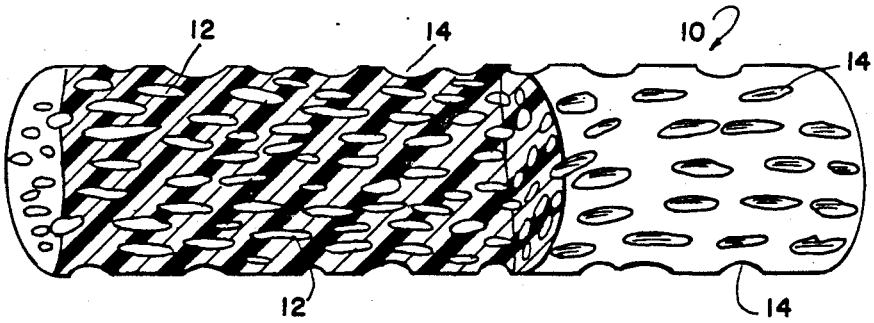
FIG. 2 (PRIOR ART)
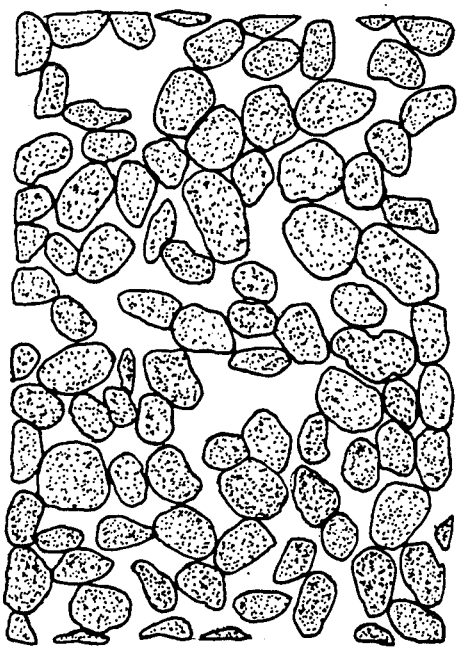
FIG. 3
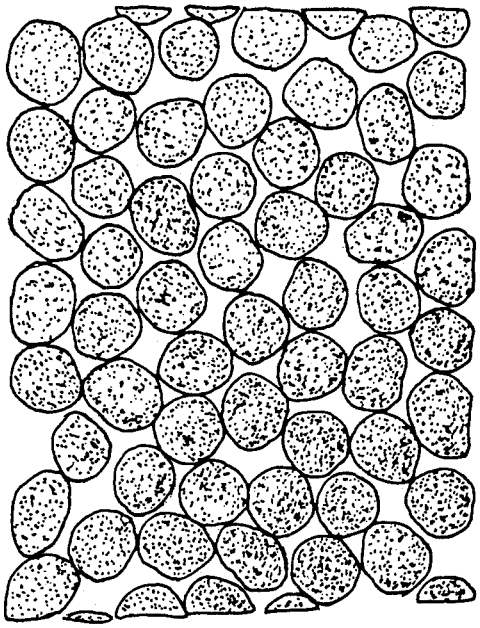
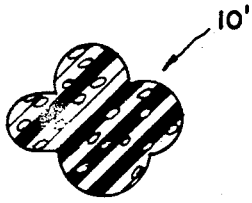
FIG. 4
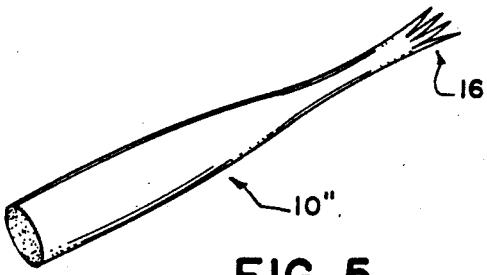
FIG. 5

FIG. 6
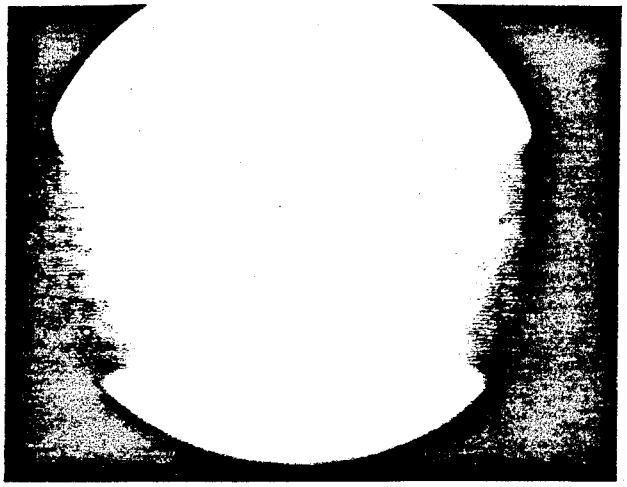
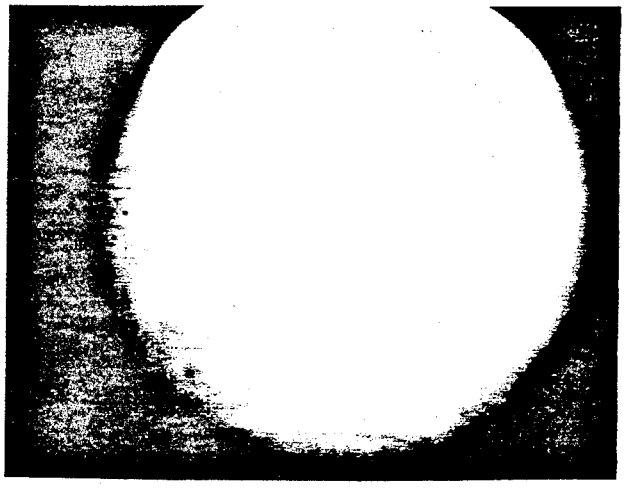
FIG. 7
FIG. 8
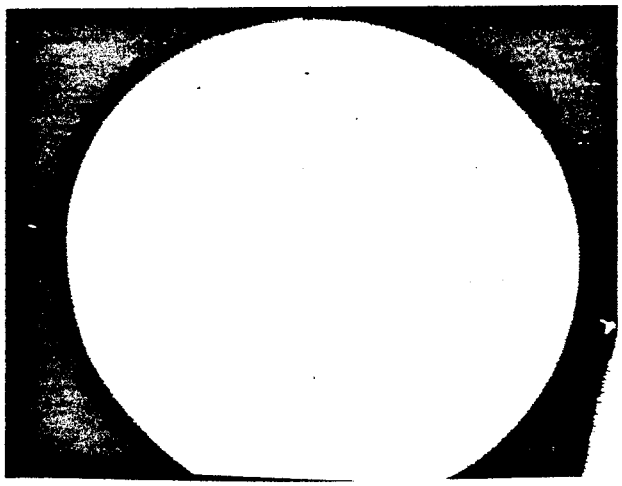

MICROCELLULAR SYNTHETIC PAINTBRUSH BRISTLES

FIELD OF INVENTION

The present invention relates to improved paintbrush bristles, and more particularly to microcellular synthetic paintbrush bristles.

BACKGROUND OF THE INVENTION

Although synthetic resin paintbrush bristles have been long known and have even acquired a substantial market in the manufacture of paintbrushes, many paintbrushes continue to be made from hogs' hair. However, hogs' hair presents many difficulties, including expense, fluctuating market supply, and handling difficulties by the paintbrush manufacturer. Advantages of hogs' hair are its naturally flagged tips and its scaly surface which helps hold wet paint in the paintbrush during use. A further disadvantage, in addition to those of high cost and inconsistent availability as pointed out above, is its irregular cross-section as shown in FIG. 2 which is a photomicrograph of a transverse cross-section of a group of hogs' hair bristles, and which clearly illustrates the noncircular cross-section. The circular cross-section is desirable to the paintbrush manufacturer during manufacturing of the brush.

It has long been desired to provide a synthetic paintbrush bristle which has all the attributes of hogs' hair and none of its disadvantages, and the patent literature contains many examples including Ward et al U.S. Pat. No. 4,307,478 and U.S. Pat. No. 4,409,372; Shaw U.S. Pat. No. 3,186,018; Lewis et al U.S. Pat. No. 3,256,545; Grobert U.S. Pat. No. 3,344,457; Curtin et al U.S. Pat. No. 3,706,111; Nakashima U.S. Pat. No. 4,559,268; Alfthen U.S. Pat. No. 2,418,492; Crampton U.S. Pat. No. 3,173,163; and Ingraito U.S. Pat. No. 2,697,009. From these prior patents, it will be seen that it has been proposed to make paintbrush bristles of a variety of cross-sectional shapes, level or tapered, hollow or solid, and formed of a variety of synthetic plastic materials.

Hollow synthetic paintbrush bristles have become very popular and among these the tapered hollow bristle as shown in the aforementioned Ward U.S. Pat. No. '478 has achieved wide acceptance. Also see Ward et al U.S. Pat. No. 4,376,746. One problem, however, is that hollow bristles cannot be satisfactorily tipped, something which is desirable for paintbrush bristles. In addition, the surface of synthetic paintbrush bristles, whether hollow or solid, and whether tapered or level, tends to be relatively smooth, and these synthetic bristles therefore lack the wet paint holding properties of rough surfaced hogs' hair bristles.

The manufacture of cellular or porous bristles or filaments is also known, although no microcellular paintbrush bristle has ever previously been successfully made, insofar as is known. In this regard, paintbrush bristles require a number of particular physical characteristics not necessary in, or contrary to, those of textile yarns and other types of brush bristles, e.g. a high stiffness to weight ratio. Patents which mention porous or cellular broom bristles or porous textile yarns useful for the manufacture of fabrics include Lewis U.S. Pat. No. 3,411,979; Charvat U.S. Pat. No. 3,577,839, Narota U.S. Pat. No. 4,552,810; Halbig U.S. Pat. No. 2,907,096; Fujimura U.S. Pat. No. 4,485,141; Hickman U.S. Pat. No. 3,785,919; Mixon U.S. Pat. No. 3,893,957; Skochdopole U.S. Pat. No. 3,723,240; Okie U.S. Pat. No. 4,144,371; and Bloch U.S. Pat. No. 2,200,946. Textile filaments are very fine and limp, while broom bristles are coarse and very stiff. However, microcellular bristles especially adapted for paintbrush use and having the desired characteristics have either not been previously contemplated or have not been able to be successfully made.

Monofilaments have also been prepared from synthetic materials so as to provide a surface which is rough and irregular. In this regard there may be mentioned Hansen U.S. Pat. No. 3,671,381; Charvat U.S. Pat. No. 3,134,122; Sawkiw U.S. Pat. No. 3,325,845; Ono U.S. Pat. No. 3,567,569; Yamaguchi U.S. Pat. No. 4,254,182; Matsumoto U.S. Pat. No. 4,297,414; and Brody U.S. Pat. No. 4,522,884.

For whatever the reason, a microporous paintbrush bristle having desirable characteristics including the desirable characteristics of the natural hogs' hair bristle, and further having addition advantages over natural hogs' hair bristle, has not previously been available. These characteristics include high "snap-back" stiffness, a high stiffness to weight ratio, cross-sectional uniformity, a rough paint-holding surface, flagged or tipped end, and low price. It is believed that while it might have been known that a cellular paintbrush bristle would be desirable, no one knew how to make such a bristle having the desired characteristics.

SUMMARY

It is, accordingly, an object of the present invention to overcome deficiencies of the prior art, such as indicated above.

It is another object to provide improved paintbrush bristles having a microcellular form which can be tipped or flagged and which have a rough surface, thereby simulating the good characteristics of natural hogs' hair bristles.

It is yet another object of the invention to provide a process for making satisfactory microcellular synthetic paintbrush bristles.

It is still another object of the invention to provide superior paintbrush bristles having surprisingly superior "snap-back" stiffness.

It is a further object of the present invention to provide a synthetic bristle useful in the manufacture of paintbrushes and having reduced weight, microcellularity, high "snap-back" stiffnness, a high stiffness to weight ratio, good cross-sectional uniformity, a surface which holds wet paint well, an end which can be flagged or tipped, and low cost.

The superior paintbrush bristle according to the invention has a length of about 1.5–7 inches and a median diameter of about 5–14 mils; it can be tapered or level. It is formed from nylon, polyester, polyolefin or blends of these materials. It has a generally consistent cross-sectional shape along its length and a rough and irregular surface with one tip end thereof being flagged or tipped or capable of being flagged or tipped. On a volume basis, it comprises 15–40% cells, these cells being predominantly closed cells of generally elongated egg-shape in the interior of the bristle, but being open along the wall of the bristle to form a rough and irregular surface which holds wet paint well. The cells typically have a length of about 1 to 6 mils and a diameter of 0.3 to 0.9 mils, and the bristle has a stiffness in the range of 1.8 to 7.5 foot pounds per cubic inch (as measured in a bundle by the pendulum deflection method at a binding angle of 50°).

Such a bristle is obtained by careful control of the extrusion process, including proper selection of starting materials and process parameters. In particular, selection of the blowing agent and amount thereof, and extruder zone temperatures are very important.

The above and other objects and the nature and advantages of the instant invention will be more apparent from the following detailed description of embodiments, taken in conjunction with the drawing wherein:

BRIEF DESCRIPTION OF DRAWING

FIG. 1 is an enlarged schematic view, partly in section, of a level bristle in accordance with the present invention;

FIG. 2 is a representation of the end of a bundle of hogs' hair bristles; and FIG. 3 is a similar representation of the end of a bundle of microcellular bristles according to the present invention;

FIG. 4 is a schematic transverse cross-section of a polylobal paintbrush bristle in accordance with the present invention;

FIG. 5 is a schematic perspective view of a tapered paintbrush bristle having a flagged tip;

FIG. 6 is a xerographic enlargement of a 100X photomicrograph of a microcellular bristle according to the invention showing its surface roughness;

FIG. 7 is an enlarged xerographic copy of a 200X photomicrograph of a longitudinally cut bristle according to the present invention showing its internal microcells; and FIG. 8 is a xerographic enlargement of a 200X photomicrograph of a cross-section of microcellular bristle according to the invention.

DETAILED DESCRIPTION OF EMBODIMENTS

FIG. 1 schematically shows a paintbrush bristle 10 in accordance with the present invention, the left part of the figure showing the bristle 10 in axial cross-section. Also see the photomicrographs of FIGS. 6–8. The bristle is formed of a thermoplastic material typically used in the manufacture of paintbrush bristles, e.g. nylon, polyester, a polyolefin, or blends thereof, e.g. blends of polyester and polyolefin, of nylon and polyester, or of nylon and polyolefin.

The bristle 10 will normally have a length in the range of 1.5 to 7 inches, depending on the intended size of the paintbrush in which the bristle is to be used. It is preferred that the bristle 10 have a circular cross-section as shown in FIGS. 1 and 3, and this is one of the main advantages of the present synthetic bristle compared with natural hogs' hair which has an inconsistent or irregular cross-section as shown in FIG. 2. The round or circular cross-section is advantageous to the brush manufacturer during the brush manufacturing process because it is typical to mix different sizes of bristles, and it requires less mixing when the bristles are circular thereby reducing manufacturing costs and providing the brush manufacturer with greater control to provide the best mixture of different bristles to maximize desirable brush characteristics.

For level, i.e. nontapered, bristles the diameter is generally in the range of 5 to 14 mils, and preferably 8 to 12 mils. For tapered bristles, the range is desirably 7/4 mils to 18/10 mils, it being understood that the first figure of each pair is the diameter at the large or butt end and the second figure is the diameter at the small or tip end.

As shown in FIGS. 1, 7 and 8, the bristle 10 of the present invention is particularly characterized in having a large member of microvoids or microcells 12 throughout its interior. These microcells 12 are predominantly closed cells throughout the interior of the bristle 10, except that such bristle also has a pocked or open-celled skin with open surface cells 14 so as to give the bristle 10 a rough and irregular surface which holds wet paint in a superior manner compared to previous synthetic bristles. The total void space in the bristle 10 according to the present invention is about 15–40% on a volume basis. Preferably, the bristle is about 70% solid having about 30% by volume of the microcells 12 and 14. The microcells 12 and 14 typically have a length of about 1 to 6 mils and a diameter of about 0.3 to 0.9 mils. The cells are generally of an elongated egg-shaped configuration with a length: diameter ratio of about 3–6:1 and having an axial cross-sectional area (see FIG. 7) of about $1.4–3.4\times10^{-5}$ in$^2$.

FIG. 4 schematically shows that a bristle 10' of the present invention may have a cross-section other than circular, e.g. in the case of FIG. 4 a tetralobal cross-sectional configuration. The microcellular bristle can also be hollow. In FIG. 5 a bristle 10'' is shown having a tapered configuration and having its end 16 flagged. It will be understood that the bristle 10 of FIG. 1 may also have its end flagged or tipped, as well as the bristle 10'' of FIG. 4, and also that a polylobal bristle such as the bristle 10'' of FIG. 4 can be tapered as shown in FIG. 5 rather than being level as shown in FIG. 1. A particular advantage of the non-hollow bristle of the present invention is its ability to have its end tipped; this is not possible with hollow bristles.

Particularly important and surprising characteristics of the bristles 10, 10' and 10'' of the present invention are their stiffness properties. The bristles of the present invention have a stiffness which in diameters of about 9 mils and above is not merely just as good as solid synthetic bristles, but actually is superior. For example, a stiffness comparison according to the pendulum deflection test at 50° rotation was made between tapered bristles in accordance with the present invention made of polyester and having a diameter at the butt end of 12 mils and a diameter at the tip of 8 mils, and otherwise identical bristles made of the same polyester blend, but not microcellular. In this test, the solid round bristles according to the prior art had a stiffness of 1.9 foot pounds per cubic inch, while the microcellular round bristles of the present invention had a stiffness of 3.2 foot pounds per cubic inch.

Bristles according to the present invention have many advantages over those of the prior art as already pointed out above. In addition, there is a significant yield advantage due to a reduced usage of polymer to provide an equal volume of bristles. In terms of specific gravity, the following comparison is typical:

| | |
|---|---|
| conventional polyester bristles | 1.31 g/cc |
| microcellular polyester bristles | 0.92–1.03 g/cc |
| hogs' hair bristles | 1.18 g/cc |

Therefore the microcellular bristle not only simulate hogs' hair but it is better than hogs' hair because it is rounder, more consistent and offers a yield advantage to the brush manufacturer. Thus, advantages include:

1) Increased yield to the brush maker, e.g. more brushes per pound of bristle.
2) irregular, rough or orange peel like surface which is similar to natural bristle and yet is a polymeric material.
3) In a solid round configuration, the yield of a hollow bristle is obtained yet the bristles can be tipped like solid round bristles. Hollow bristles cannot be tipped.

Processing is critical to obtain the microcellular bristles of the present invention. The chemical blowing agent is introduced with the different polymers into the extruder. Using specific extrusion temperatures that control the rate of blowing, the chemical blowing agent is extruded with the polymer through a die or spinneret which determine the size and cross-section of the bristle. As in normal monofilament production the bristles are quenched in a water bath, oriented in a single or double stage oven arrangement and then annealed. The product is then cut or wound on different types of packages.

Particularly important are the proper selection of a blowing agent and the extruder temperature profile. Thus, the microcellular bristles of the invention are formed during the extrusion process by disassociation of a chemical blowing agent. A number of these have been tried and many were unsatisfactory including Hostatron P1941 (Hoechst) and PBT blowing agent (General Electric). Other unacceptable blowing agents are those based on azo compounds such as azodicarbonamide and diisopropyl hydrazo dicarboxylate. Other blowing agents were unsatisfactory because of poor compatibility, e.g. poor dispersibility in the polymer melt, including Expandex 175 (barium salt of 5-phenyl tetrazole) and Expandex 5PT (5-phenyl tetrazole), both products of Olin. Blowing agents were unsuccessful because, among other reasons, some would not activate at the processing temperatures of the polymers, and/or resulted in processing problems with downstream conditions so that required physical properties such as flex, draw ratio, bristle size control, blowing, could not be achieved.

Blowing agents found to be most satisfactory are based on a solid acid and solid base, such as citric acid and basic sodium bicarbonate. Most satisfactory was Hydrocerol CF 70, (Boehringer Ingelheim) which comprises a mixture of citric acid and basic sodium carbonate. Blowing agents of this type are unique because, even though full activation does not occur until 510° F., the blowing agent begins to be activated at a much lower temperature, i.e. about 320° F. Unsatisfactory blowing agents, on the other hand, have either a fixed activation temperature or an initial activation temperature which is much greater, e.g. 470–520° F.

The quantity of blowing agent is also very important. Thus, the quantity of blowing agent must not exceed 2% by weight based on the total composition, and the preferred range is 0.4–1% by weight, with the most preferred quantity being about 0.7%. Quantities less than about 0.3% give insufficient blowing, while quantities above about 2.0% give an uncontrolled open cellular product with unsatisfactory properties. As a result of the use of the preferred blowing agents, the resultant bristle contains the reaction products of the blowing agent components, e.g. carbon dioxide and sodium citrate, as well as in some cases a very small quantity of unreacted blowing agent; it is unknown whether or not these residues in the final product contribute to its superior properties.

With regard to processing parameters, in general there is considerably more latitude in processing polymers without blowing agents than those with blowing agents. In particular, specific extrusion temperatures are required to achieve the desired cell structure inside the bristle and to achieve the desired surface characteristics. In general it has been found that in order to make satisfactory bristles according to the invention, the beginning zones in the extruder must be cooler than normal. For example, where the polymer is nylon 6,12 or polyolefin, the first two zones of the extruder should be kept at about 490° F. when manufacturing microcellular bristles, whereas a temperature of 500° F. in these two zones is usual when making noncellular bristles. Similarly, when making polybutylene terephthalate bristles and bristles of polyester/nylon blends, the first and second extruder zones are normally kept at 600 and 590° F., respectively, for the manufacture of noncellular bristles, whereas use of the same polymers to make microcellular bristles requires that the first and second extruder zones be maintained at only 520° F.

The following examples of the invention are offered illustratively:

EXAMPLE 1

Microcellular nylon 6,12 bristles in accordance with the present invention are made in both level and tapered forms using the standard extrusion equipment normally in the manufacture of noncellular paintbrush bristles. As blowing agent there is used the above-mentioned Hydrocerol CF 70 in an amount of 0.7 weight percent. The temperature profile in the extruder, in comparison with the temperature profile for the standard noncellular bristle, is set forth in Table 1 below:

TABLE 1

| | Standard | With Blowing Agent |
|---|---|---|
| Extruder Zone #1 | 500° F. | 490° F. |
| Extruder Zone #2 | 500° F. | 490° F. |
| Extruder Zone #3 | 500° F. | 500° F. |
| Extruder Zone #4 | 500° F. | 525° F. |
| Transition Zone | 500° F. | 535° F. |
| Transition Zone | 500° F. | 535° F. |
| Spin Pump | 500° F. | 510° F. |
| Transition Zone | 500° F. | 510° F. |
| Die | 500° F. | 510° F. |

The resultant microcellular bristles have excellent properties in both level and tapered bristles, and the tip ends thereof are easily flagable or tipable.

EXAMPLE 2

Example 1 is repeated using nylon 6,10, nylon 6 and nylon 6,6. In all cases, excellent quality microcellular bristles are obtained.

EXAMPLE 3

The process of Example 1 is again repeated using polypropylene as the polymer, and with the same temperature profile as shown above in Table 1. Again, microcellular paintbrush bristles of excellent quality are obtained.

EXAMPLE 4

The process of Example 1 is again carried out, this time using polybutylene terephthlate, and tapered microcellular bristles are produced using the temperature profile shown in Table 2 below (again in comparison with the standard temperature profile used in the manufacture of noncellular bristles):

TABLE 2

| | Standard | With Blowing Agent |
|---|---|---|
| Extruder Zone #1 | 600° F. | 520° F. |
| Extruder Zone #2 | 590° F. | 520° F. |
| Extruder Zone #3 | 560° F. | 510° F. |
| Extruder Zone #4 | 560° F. | 525° F. |
| Transition Zone | 540° F. | 530° F. |
| Transition Zone | 540° F. | 525° F. |
| Spin Pump | 550° F. | 550° F. |
| Transition Zone | 510° F. | 510° F. |
| Die | 510° F. | 510° F. |

Again the results are excellent and the resultant microcellular polyester bristles are of excellent quality.

EXAMPLE 5

The process of Example 4 is repeated using a blend predominantly of polyester with a small amount of nylon 6,12. Again, the results are highly satisfactory with excellent quality microcellular tapered paintbrush bristles resulting.

EXAMPLE 6

Microcellular polyester level bristles according to the present invention were comparatively tested with otherwise equal non-cellular polyester bristles for stiffness. Three different sizes were tested, namely 8 mil circular, 10 mil circular and 12 mil circular. Stiffness was tested according to the pendulum deflection method wherein a bundle of bristles with a measured bundle cross-sectional area is rotated against a bending bar. The pressure of the bristles against the bar moves a pendulum, and the difference in rotation angles of the bristle bundle base and the pendulum is a measure of the stiffness or flexibility of the bristles. The results were as set forth below in Table 3:

TABLE 3

| 8 mil Standard 3" | 8 mil level microcellular 3" |
|---|---|
| 2.2 ft. lbs./in$^3$ @ 50° | 2.3 ft. lbs./in$^3$ @ 50° |
| 2.0 ft. lbs./in$^3$ @ 50° | 2.0 ft. lbs./in$^3$ @ 50° |
| 2.2 ft. lbs./in$^3$ @ 50° | 2.2 ft. lbs./in$^3$ @ 50° |
| 2.2 ft. lbs./in$^3$ @ 50° | 2.2 ft. lbs./in$^3$ @ 50° |
| 2.2 ft. lbs./in$^3$ @ 50° | 2.2 ft. lbs./in$^3$ @ 50° |
| **10 mil Standard 3"** | **10 mil level microcellular 3"** |
| 3.8 ft. lbs./in$^3$ @ 50° | 4.5 ft. lbs./in$^3$ @ 50° |
| 4.1 ft. lbs./in$^3$ @ 50° | 5.5 ft. lbs./in$^3$ @ 50° |
| 4.1 ft. lbs./in$^3$ @ 50° | 5.0 ft. lbs./in$^3$ @ 50° |
| 4.1 ft. lbs./in$^3$ @ 50° | 5.0 ft. lbs./in$^3$ @ 50° |
| 4.1 ft. lbs./in$^3$ @ 50° | 5.0 ft. lbs./in$^3$ @ 50° |
| 4.1 ft. lbs./in$^3$ @ 50° | 5.0 ft. lbs./in$^3$ @ 50° |
| **12 mil Standard 3"** | **12 mil level microcellular 3"** |
| 4.5 ft. lbs./in$^3$ @ 50° | 6.8 ft. lbs./in$^3$ @ 50° |
| 4.5 ft. lbs./in$^3$ @ 50° | 7.6 ft. lbs./in$^3$ @ 50° |
| 4.5 ft. lbs./in$^3$ @ 50° | 7:6 ft. lbs./in$^3$ @ 50° |
| 4.5 ft. lbs./in$^3$ @ 50° | 7.6 ft. lbs./in$^3$ @ 50° |
| 4.5 ft. lbs./in$^3$ @ 50° | 6.8 ft. lbs./in$^3$ @ 50° |
| | 7.6 ft. lbs./in$^3$ @ 50° |

It will be obvious to those skilled in the art that various other changes and modifications may be made without departing from the scope of the invention and the invention is not to be considered limited to what is shown in the drawings and described in the specification.

What is claimed is:

1. A microcellular paintbrush bristle having a length of about 1.5 to 7 inches and a median diameter of about 5 to 14 mils, said bristle being formed of oriented thermoplastic material selected from the group consisting of nylon, polyester, polyolefin and blends thereof, and having a generally consistent cross-sectional shape along its length and a rough and irregular surface with one end thereof being flagged or tipped, said bristle comprising 15 to 40% axially elongated cells on a volume basis, said cells being of generally uniform distribution and being predominantly closed in the interior of said bristle and open along the wall of said bristle to form said rough and irregular surface, said cells having a length of about 1 to 6 mils and a diameter of about 0.3 to 0.9 mils, said bristle having a stiffness in the range of 1.8 to 7.5 ft. lbs./in$^3$.

2. A synthetic microcellular bristle according to claim 1 which is tapered along its length.

3. A synthetic microcellular bristle according to claim 1 having a circular cross-section.

4. A synthetic microcellular bristle according to claim 1 having a multi-lobal cross-section.

5. A synthetic microcellular bristle according to claim 1 formed of polyester.

6. A synthetic microcellular bristle according to claim 1 formed of nylon 6,12.

7. A synthetic microcellular bristle according to claim 1 formed of a blend of polyester and polyolefin.

8. A synthetic microcellular bristle according to claim 1 formed of a blend of nylon and polyester.

9. A synthetic microcellular bristle according to claim 1 formed of a blend of nylon and polyolefin.

10. A synthetic microcellular bristle according to claim 1 further comprising a small amount of sodium citrate, and wherein said cells contain predominantly carbon dioxide.

11. In a method of manufacturing synthetic paintbrush bristles by extrusion from an extruder of a plastic melt, and solidification thereof, the improvement wherein 0.3 to 2% by weight of a blowing agent based on the total composition is fed to the extruder, said blowing agent comprising a mixture of a solid base and a solid acid and having an initial activation temperature lower than the temperature within said extruder; and maintaining first and second zones in said extruder at a lower than normal temperature.

12. A method according to claim 1 wherein said blowing agent is present in an amount of 0.4 to 1%, comprises a mixture of citric acid and basic sodium carbonate, and has an initial activation temperature of about 320° F. and normal activation temperature of about 510° F.

* * * * *